United States Patent [19]

Berber

[11] 4,228,951

[45] Oct. 21, 1980

[54] CENTRIFUGAL LIQUID PURIFIER

[76] Inventor: Viktor A. Berber, Shelkovichnaya ulitsa, 184, kv. 65, Saratov, U.S.S.R.

[21] Appl. No.: 909,976

[22] Filed: May 26, 1978

[30] Foreign Application Priority Data

Jun. 20, 1977 [SU] U.S.S.R. ..... 2489796

[51] Int. Cl.[2] ..... B04B 11/06

[52] U.S. Cl. ..... 233/31

[58] Field of Search ..... 233/3, 21, 27, 28, 29, 233/31, 30, 36, 37, 42, 43

[56] References Cited

U.S. PATENT DOCUMENTS

| | | | |
|---|---|---|---|
| 521,722 | 6/1894 | Melotte et al. | 233/30 |
| 937,986 | 10/1909 | Carlsson | 233/21 |
| 1,603,125 | 10/1926 | Lewis | 233/31 |
| 2,067,273 | 1/1937 | Knowles et al. | 233/28 |
| 2,450,737 | 10/1948 | Rundquist | 233/31 |
| 2,808,201 | 10/1957 | Mayeux | 233/28 |
| 4,071,188 | 1/1978 | Afonin | 233/29 |

FOREIGN PATENT DOCUMENTS

| | | | |
|---|---|---|---|
| 729169 | 5/1955 | United Kingdom | 233/30 |
| 510022 | 12/1976 | U.S.S.R. | 233/27 |

*Primary Examiner*—George H. Krizmanich
*Attorney, Agent, or Firm*—J. Harold Nissen

[57] ABSTRACT

A centrifugal liquid purifier comprising a vertically extending hollow axle secured on a base and having an inlet and an outlet for liquid, both the inlet and the outlet communicate with respective spaces of a cylindrical rotor mounted on the axle. The casing of the rotor accommodates a bushing arranged coaxially with the hollow axle and is provided with a spiral-shaped band fixed thereon; and with spacers located one after another between adjacent turns of the band in parallel with the hollow axle. The spacers form radial rows and together with the band define slit passages for liquid. The band is made with crimps which run parallel with the hollow axle, while the spacers are located in the crimp tops.

8 Claims, 4 Drawing Figures

CENTRIFUGAL LIQUID PURIFIER

The present invention relates to devices for purifying liquid and, more particularly, it relates to centrifugal liquid purifiers.

The centrifugal liquid purifier according to the present invention can be used most advantageously for purifying liquid such as oil, fuel and the like from mechanical impurities.

Known in the art is a centrifugal liquid purifier comprising a vertically extending hollow axis fixed on a base and having an inlet and an outlet for liquid. Mounted in sliding bearings on the axis is a cylindrical rotor including a casing, a bushing with a spiral-like shaped band fixed thereon, and top and bottom impellers respectively located above and below the spiral-like shaped band.

Between adjacent turns of the spiral-like shaped band spacers are located one after another in parallel with the axle, which form radial rows and define, together with the band, slits. The liquid being purified is supplied to said slits via spaces formed by the impeller flanges and band spiral end faces.

In the slits, under the effect of centrifugal field, liquids are separated from mechanical impurities which precipitate on the band surface.

In such a purifier, the removal of deposited particles with the flow of liquid increases as the gap between adjacent turns of the spiral gets smaller, which becomes especially apparent upon increasing the flow rate and viscosity and when purifying liquids featuring a relatively small difference between the densities of the dispersed and dispersion media, this affecting the degree of purification of liquid (cf., Swedish Pat. No. 392676).

There is also known a centrifugal liquid purifier wherein the rotor comprises a stack of crimped cone-shaped plates. The crimps of each plate are directed along the generatrix of the cone-shaped plate.

The matching tops and depressions of the crimps in the stack of plates are on the same vertical lines, and the gaps between the plates are maintained by means of pins welded to the crimp tops. During separation, the heavy phase moves towards the periphery over the crimp tops while the light phase is directed towards the center along the crimp depressions (cf., Japanese Pat. No. 51-14306).

The afore-described purifier is deficient in that Coriolis forces emerging in the gaps between the plates (in the slits) due to the presence of the radial component of liquid flow disorganize the flow and reduce the efficiency of the centrifugal purifier operation.

Used as the prototype is the former one of the aforedescribed centrifugal purifiers.

It is an object of the present invention to provide a centrifugal purifier wherein the structural embodiment of the rotor band would help improve the purification of liquid from mechanical impurities.

It is another object of the present invention to increase the duration of continuous operation of the purifier without removing precipitated impurities from the rotor.

In accordance with the aforesaid and other objects of the present invention, disclosure is made of a centrifugal liquid purifier comprising a vertically extending hollow axle fixed on a base and having a liquid inlet and a liquid outlet, both said liquid inlet and liquid outlet communicated with respective spaces of a cylindrical rotor mounted on said axle, the casing of said rotor accommodating a bushing arranged coaxially with the hollow axle and provided with a spiral-like-shaped band fixed thereon, with spacers being located one after another between adjacent turns of the band in parallel with said hollow axle, said spacers forming radial rows and defining together with said band slit passages for liquid, wherein, according to the invention, said band is made crimped with crimps running parallel with the hollow axle, while said spacers are located in crimp tops.

It is expedient that, over the entire length of each radial row formed by the spacers, on the side of the outlet end of the cylindrical rotor, provision should be made of plates projecting on both sides from the radial row of spacers through a value amounting to 20–40% of the width of the slit passage for liquid.

The provision of such plates makes for the retention of particles whose density is close to that of the liquid being purified, moving along the spacers, and for the accumulation of said particles in the form of precipitate.

The centrifugal liquid purifier according to the present invention makes for a many-fold improvement of the fineness of purification, especially in the case of purification from impurities having particles of relatively low density, for example, rubber.

The present invention will be better understood upon considering the following detailed description of an exemplary embodiment thereof, with due reference to the accompanying drawings in which:

FIG. 2 is a fragment of the band spiral cross-section taken for example on line 2—2, but shown on the other side of the drawing of FIG. 1;

Figure 1:
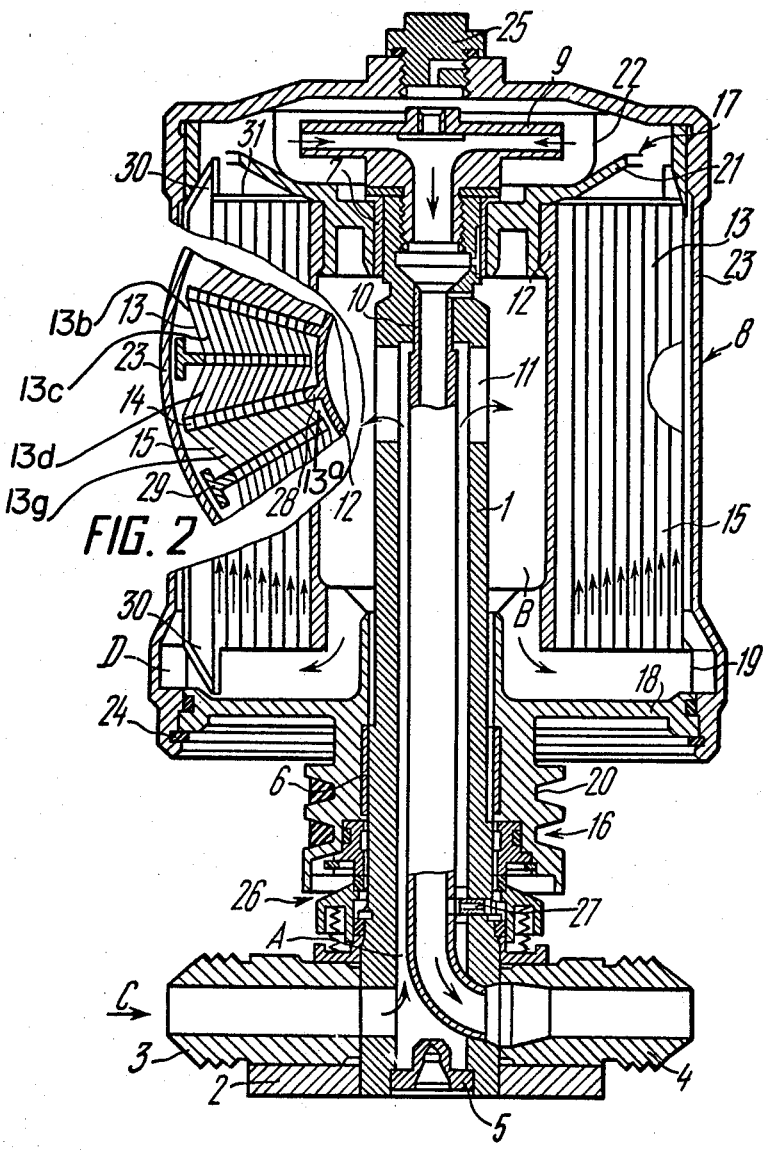
FIG. 1 shows the centrifugal liquid purifier according to the invention in longitudinal section.

Referring now to FIG. 1 of the drawings, the centrifugal liquid purifier according to the invention comprises a hollow axle 1 fixed with its lower end on a base 2. In its bottom portion, space A of the axle 1 is communicated with a union 3 serving as an inlet for the liquid being purified to the purifier and with a union 4 serving as an outlet for the purified liquid.

The fixed end of the axle 1 is covered with a flange 5. Mounted in bearings 6 and 7 on the axle 1 is a cylindrical rotor 8 designed for centrifugal purification of liquid. A pressure disk 9, mounted on the top end of the axle 1, serves to connect the inner space of the rotor 8 via pipe 10 located inside the space A of the axle 1 with the union 4. The pressure disk 9 is designed for pumping the purified liquid and, at the same time, it serves as the top thrust bearing of the rotor 8. Apertures 11 are provided in the hollow axle 1 for supplying liquid to space B of the rotor 8. The rotor 8 accommodates a bushing 12 with a spiral-shaped band 13 wound thereon, between the turns of which band spacers 14 (FIG. 2) are located one after another in a radial direction in parallel with the axle 1, said spacers forming radial rows arranged uniformly on a circle. The spacers 14 together with the turns of the band 13 define slit passages 15 the value of whose gaps depends upon the thickness of the spacers 14. Press-fitted in the bushing 12 is a bottom impeller 16 (FIG. 1) and a top impeller 17, respectively located below and above the spiral-like-form of the band 13. The bottom impeller 16 comprises a flange 18 with ribs 19 arranged radially uniformly on a circle, and a bottom portion in the form of a pulley 20 by means of which the rotor 8 is connected via V-belt drive (not shown) with its drive (not shown). The impeller 16 is designed to circulate the liquid and center the rotor 8 in the bearing 6.

The top impeller 17 comprises a flange 21 with ribs 22 arranged radially uniformly on a circle and is designed for centering the rotor 8 in the bearing 7 and for circulating the liquid.

For supplying the liquid to the slit passages 15, use is made of space B defined by the bushing 12, axle 1 and radial channels of the impeller 16.

The rotor 8 is covered with a casing 23 locked in position in the flange 18 of the impeller 16 by means of a collar spring 24.

Provided in the top portion of the casing 23 is a port for the discharge of air when filling the rotor 8 with liquid, said port being stopped with a plug 25. In order to preclude the leakage of liquid from the rotor 8, a seal 26 is provided between the bottom impeller 16 and the axle 1.

For supplying the purified liquid to the seal 26 and bearing 6, a channel 27 is provided in the axle 1.

The band 13 is made crimped, as shown in FIG. 2, with crimps running parallel with the hollow axle 1, while the spacers 14 are located in the crimp tops and form radial rows uniformly arranged on a circle.

For obtaining and fixing crimps, on the bushing 12 there are provided ribs 28 arranged uniformly on a circle passing through a row of the spacers 14 on which appropriate rows of spacers rest, while on the side of the casing 23 ribs 29 are located such as to alternate with the ribs 28 on which appropriate rows of the spacers 14 rest. The ribs 29 (see FIGS. 1 and 2) are provided at their top and bottom ends with conical projections 30 receivable in corresponding depressions of the ribs 19 and 22, respectively, in the bottom impeller 16 and top impeller 17.

The spiral-like-shaped band 13 is composed of individual straight lines and has one end 13*a* starting out at one of the band spacers 14 and continues in a spiral-like fashion and terminates at its other end 13*b* at another of the band spacers. End 13*b* could equally well terminate at the same band spacer 14. The band increases and decreases in radius sequentially around a straight line while increasing overall sequentially as each turn moves away from the straight line.

The spiral-like-shaped band 13 extends in a zig-zag-like fasion with intermediate straight lines composed of a first portion 13*c* extending in a first direction and a second portion extending in a second direction 13*d* to form an angle between adjacent first and second portions 13*d* and 13*c*. The angle is formed with the apex on the spacers 14 connected with ribs 28, and the other angle is formed with the spacers 14 connected with the ribs 29.

Figure 3:
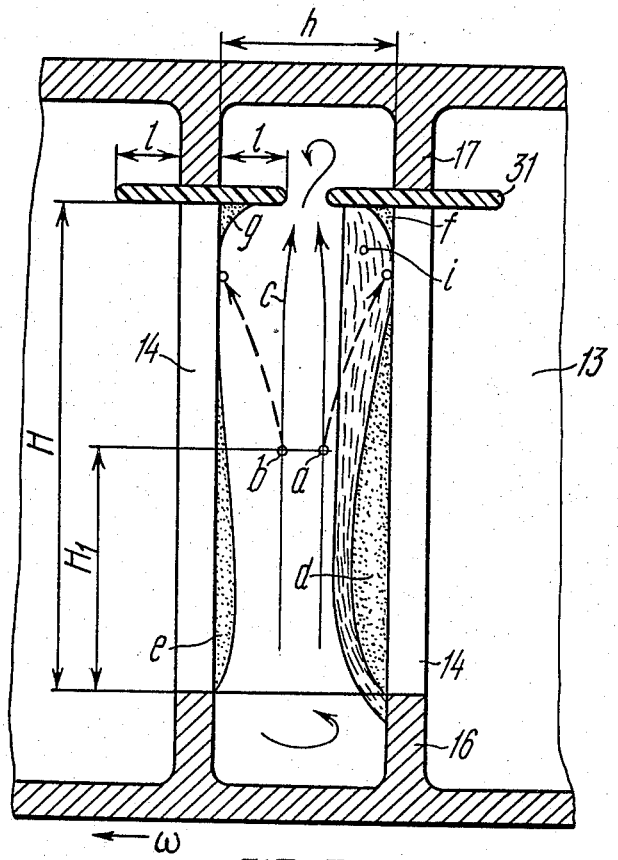
FIG. 3 is an evolved view of the band with spacers, on an enlarged scale taken on line 3—3 of FIG. 1.

For entrapping particles whose density is close to that of the liquid being purified, plates 31 (FIGS. 1, 3) are provided over the entire length of each row of the spacers 14 on the side of the outlet end of the rotor 8. Each plate 31 is made wider than a spacer 14 and projects on both sides from a row of the spacers 14 through a value l amounting to 20–40% of the width h of the slit passage 15. The value l depends on the viscosity of liquid being purified and on the rate of the liquid flow through the slit passage.

The centrifugal liquid purifier according to the present invention operates in the following manner.

The rotor 8 filled with liquid is set to rotation by the drive (not shown) via V-belt drive (not shown). The liquid being purified is supplied via union 3 to the centrifugal purifier. The direction of flow is shown with arrows C. Via space A, apertures 11 in the axle 1 and space B, the liquid gets to the radial channels between the ribs 19 of the impeller 16. Here, the liquid is rotated by means of the ribs 19 of the impeller 16 to reach the angular velocity of the rotor 8 and supplied, via slit passages 15 between the crimps of the spiral-like-shaped band 13, to the pressure disk 9.

Figure 4:
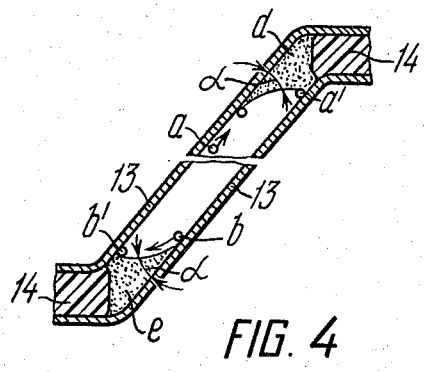
FIG. 4 shows a slit passage defined by adjacent turns of the band and the spacers, on an enlarged scale taken on line 4—4 of FIG. 3.

Particles a (FIGS. 3, 4) and b of the heavy and light dispersed phases, respectively, pass in axial direction together with the flow through the slit passage 15 over a path $H_1$ (depending on the properites of phases being separated and operating conditions of the purifier) to cross in a radial direction the slit passage 15 and precipitate onto the opposing surfaces of the band 13 and, further, owing to the tilt of the band 13, are dumped by centrifugal forces to the spacers 14 to form precipitates d and e. The sliding trajectories (shown in FIG. 3 with broken line) depend upon the relationship between the washing off force of the flow and tangential component of centrifugal force.

The precipitates d and e form a wedge-shaped zone (FIG. 4) whose inclination angle $\alpha$ corresponds to the angle of friction of microparticles. Particles that are most likely to be carried away have the minimum angle of friction and, therefore, roll down to the apex of the wedge-shaped zone of the slit passage 15 (positions a' and b') where there is practically no flow inasmuch as the liquid velocities are proportional to the square of height of the slit passage 15. Therefore, the precipitate formed of large particles and having an increased friction coefficient automatically provides conditions required for retaining in the wedge-shaped zone the particles that can be readily carried away in a conventional gap. Those of the particles that are most likely to be carried away are retained additionally by means of the plates 31 provided over the entire length of each row of the spacers 14 on the side of the outlet end of the rotor 8, i.e., in the path along which such particles may be carried away from the precipitates d and e. In addition, the plates 31 together with the spacers 14 and band 13 form in the slit passage 15 stagnant zones of considerable height, inside which zones the particles moving along the spacers 14 are stopped and accumulated in the form of precipitates f (FIG. 3) and g. The plates 31 also serve as barriers designed to retain the separated dispersed liquid phase i dumped in the form of drops in the space between the ribs of the impeller 16 and further in mud trap D (FIG. 1), or it can be removed from the purifier by any suitable conventional means. The plates 31 also serve to relieve the effect of Coriolis forces from the side of the impeller 17 upon the outlet portion of the slit passages 15, which makes for improved hydrodynamics of the flow.

What is claimed is:

1. A centrifugal liquid purifier comprising: a base; a vertically extending hollow axle fixed on said base and having an inlet for the liquid to be purified and an outlet for the purified liquid; a cylindrical rotor mounted on said hollow axle with a possibility of rotation about the latter; a drive for rotating said cylindrical rotor; said cylindrical rotor including a top impeller and a bottom impeller, arranged at the opposite ends of said hollow axis, a bushing arranged coaxially with said hollow axis between said top and bottom impellers and coupled with said impellers for joint rotation, a band attached with its one end to said bushing and spiral-like wound thereon, said band being made crimped with crimps running parallel with said hollow axle, spacers located one after another in a radial direction between adjacent turns of said band spiral form in parallel with said hollow axle in crimp tops of said band to form radial rows, slit passages for the liquid being purified defined by said spacers and said band; a casing coupled with said top and said bottom impellers and designed to cover said bushing with said band, top and bottom impellers, spaces in said casing located between the ends of said bushing with said band and said top and bottom impellers and communicated one with the inlet and the other one with the outlet of said hollow axle, said spaces communicated with each other via said slit passages, and a pressure disk being mounted in said casing on said hollow axis above the top one of said impellers and designed for pumping the liquid.

2. A centrifugal liquid purifier as claimed in claim 1, wherein over the entire length of each radial row formed by said spacers, on the side of the outlet end of said cylindrical rotor, provision is made of a plate projecting on both sides from said radial row of spacers through a value amounting to 20–40% of the width of the slit passage for liquid.

3. A centrifugal pruifier as claimed in claim 1, including a plate over the entire length of each row of said spacers on the side of said outlet end of said rotor.

4. A centrifugal purifier as claimed in claim 3, in which said plates together with said spacers and said band form in said slit passages stagnant zones for stopping particles moving along said spacers and accumulating thereof in the form of precipitates.

5. A centrifugal purifier as claimed in claim 1, including a first set of ribs on said bushing and resting against a first alternating row of said spacers, and a second set of ribs alternating with said first set of ribs and being on the side of said casing resting against a second alternating row of said spacers, said first and second alternating rows of said spacers alternating with each other for fixing said crimps, thereby to assure gap uniformity.

6. A centrifugal purifier as claimed in claim 5, including conical projections provided at the top and bottom ends of said second set of ribs, and said top impeller each including ribs provided with depressions, said conical projections being receivable within said depressions.

7. A centrifugal purifier as claimed in claim 2, including a first set of ribs on said bushing and a second set of ribs on the side of said casing, said first and said second set of ribs resting on alternating rows of said spacers so that alternate spacers rest alternatingly on one of said first sets of ribs and one of said second sets of ribs for fixing said crimps.

8. A centrifugal purifier as claimed in claim 7, including conical projections provided at the top and bottom ends of said second set of ribs for engagement with said top and said bottom impellers, respectively.

* * * * *